United States Patent [19]

Saito

[11] 3,961,440

[45] June 8, 1976

[54] SPRING PRIME MOVER UNIT

[76] Inventor: Shigeru Saito, No. 6-4, 2-chome, Kuramae, Taito, Tokyo, Japan

[22] Filed: Aug. 28, 1975

[21] Appl. No.: 608,539

[52] U.S. Cl. ..... 46/206; 46/39; 46/40; 46/104; 46/100; 46/202; 46/221; 185/39; 185/DIG. 1

[51] Int. Cl.[2] ..... A63H 17/00

[58] Field of Search ..... 46/39, 40, 100, 103, 46/104, 201, 206, 208, 221, 243 E; 185/37, 39, DIG. 1

[56] References Cited

UNITED STATES PATENTS

| | | | |
|---|---|---|---|
| 798,041 | 8/1905 | Kingsbury | 185/DIG. 1 |
| 3,541,725 | 11/1970 | Miura | 46/206 |
| 3,579,901 | 5/1971 | Perhacs | 46/103 |
| 3,599,363 | 8/1971 | Baginski | 46/39 |
| 3,728,815 | 4/1973 | Tomiyama | 46/104 |

*Primary Examiner*—F. Barry Shay
*Attorney, Agent, or Firm*—Michael J. Striker

[57] ABSTRACT

A spring prime mover unit comprising a spring prime mover, a transmission gear and a plurality of connectors. Among the connectors, there are rotatable connectors and non-rotary connectors. The rotatable connectors are the ends of some shafts of the transmission gear and the non-rotary connectors are the attachments of a covering frame. The spring prime mover unit may be exchangeably equipped with auxiliary toy parts or toys which have not prime movers and form various movable toys to one prime mover unit. Therefore, children themselves can assemble various interesting movable toys and enjoy various motion of the toys.

3 Claims, 15 Drawing Figures

SPRING PRIME MOVER UNIT

This invention relates to a spring prime mover unit which is able to work various toys and auxiliary toy parts which have not prime movers.

Heretofore, customary movable toys are almost provided with spring prime movers or electric motors and work their movable members by themselves. Accordingly, they can not play different various motions.

One object of this invention is to provide a spring prime mover unit which can be exchangeably connected with auxiliary toy parts or toys having not prime movers and can perform different various motions with said parts or said toys.

Another object of this invention is to provide a spring prime mover unit by which children themselves can assemble various movable toys with auxiliary toy parts or toys having not prime movers.

Briefly stated in accordance with this invention, there is provided a spring prime mover unit which comprises a spring prime mover, a transmission gear, a plurality of connectors, a mechanism frame and a box frame. Said connectors may be connected exchangeably with auxiliary toy parts or various toys having not prime movers. Thereby, players can assemble various interesting movable toys and enjoy various motions of the toys.

This invention will be better understood and other objects and additional advantages of this invention will become apparent upon perusal of the following description taken in connection with drawings, in which.

Figure 1:
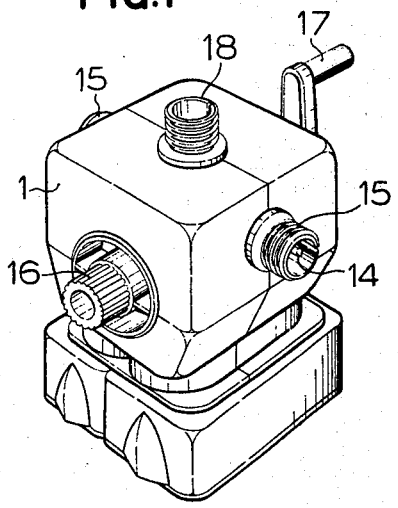
FIG. 1 is a front perspective view of a spring prime mover unit of this invention.
Figure 2:
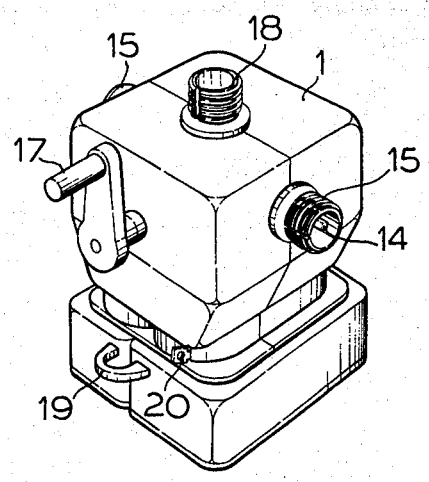
FIG. 2 is a back perspective view of the spring prime mover unit thereof.
Figure 3:
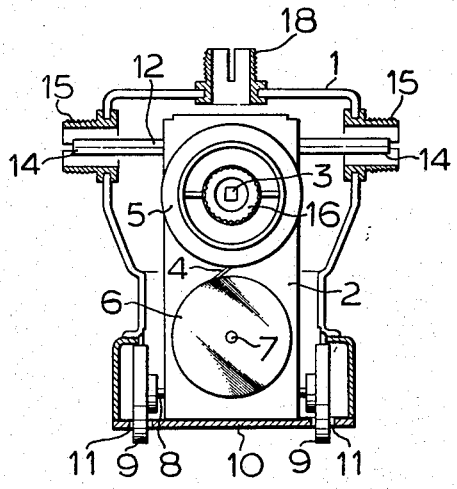
FIG. 3 is a front elevation of the spring prime mover unit cut off the front half of a box frame thereof.
Figure 4:
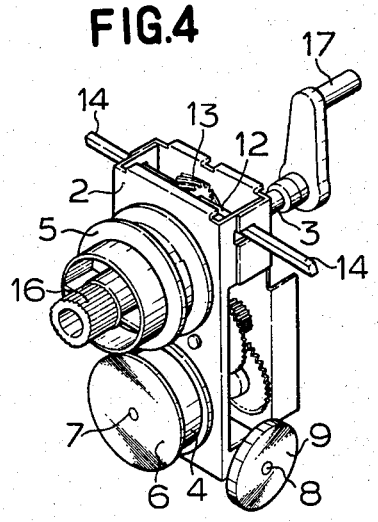
FIG. 4 is a front perspective view of the spring prime mover unit thereof taken off the box frame.

Referring more particularly to the drawings, the preferred embodiment of this invention will now be described as follows. The mechanism of this invention may be explained referring to FIGS. 1 to 4. A cubical box frame 1 is made from plastics and is equipped with a mechanism frame 2 inside it. A main shaft 3 is made to pass through the mechanism frame 2 in front and in the rear and journaled at a definite position of said frame 2. A drum 5 is attached to the front portion of the main shaft 3 outside the mechanism frame 2. Underneath and near the drum 5, a drum 6 is arranged to be mounted on a subsidiary shaft 7. A spring 4 is fixed onto the circumferences of said drums 5 and 6 by each end of it, respectively. Said spring 4 is wound about the drum 5 from the drum 6 by revolving a handle 17 and rotation power is stored in the spring 4. A rotatable shaft 8 is mounted in both sides of the lower portion of the mechanism frame 2, and a pair of small wheels 9 are attached to both ends of said rotatable shaft 8. The lower halves of said wheels 9 projects downward from a pair of slots 11 on a bottom plate 10 of the box frame 1. A square shaft 12 is arranged to pass transversely through the upper portion of the mechanism frame 2 and a worm 13 is fixed to the middle portion of said square shaft 12. Said worm 13 is adapted to be in mesh with a worm gear of the main shaft 3 and is made to rotate. Both ends 14 of said square shaft 12 are rotatable connectors and housed freely inside a pair of projecting tubular connectors 15 attached to both sides of the box frame 1. A main shaft rotatable connector 16 which is fixed to the front side of the drum 5 projects from the front of the box frame 1. The rear end of the main shaft 3 projects from the back of the box frame 1 and is fitted with the handle 17. A tubular connector 18 stands up at the center on the top of the box frame 1 and a semicircular ring connector 19 is attached to the lower middle portion of the back of the box frame 1.

The mechanism of this invention is as stated hereinbefore. Therefore, if the main shaft 3 is revolved by the handle 17, the spring 4 is wound about the drum 5 from the drum 6 and has a power of winding off from the drum 5. This power is a motive power to work toys having not prime movers or auxiliary toy parts. Then, after winding up the spring 4, if a stopper 20 is disconnected from the transmission gear, the spring 4 is made to wind off from the drum 5 and wound about the drum 6, and simultaneously the main shaft 3, the square shaft 12 and the rotatable shaft 8 are revolved.

Next, some embodiments of the spring prime mover unit equipped with auxiliary toy parts or toys having not prime movers may be described as follows.

Figure 5:
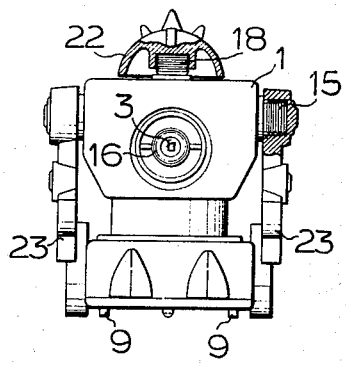
FIG. 5 is a front elevation of the spring prime mover unit thereof disguised as a robot with auxiliary toy parts.

As shown in FIG. 5, the spring prime mover unit may be disguised as a robot which wears a cap 22 on the tubular connector 18 at the top of the box frame 1 and two arms 23 to the tubular connectors 15 at the both sides of the box frame 1.

Figure 6:
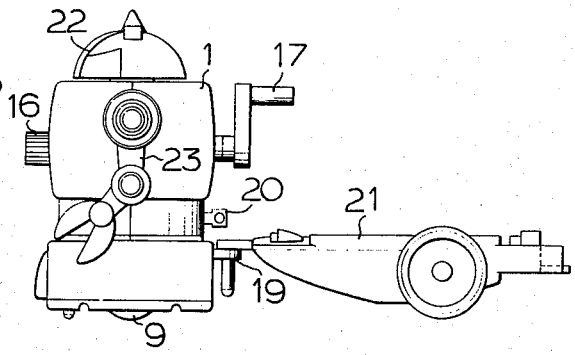
FIG. 6 is a side elevation of the robot shown in FIG. 5 drawing a trailer.

As shown in FIG. 6, if a trailer 21 is connected with the box frame 1 by the semicircular ring connector 19, the robot may draw said trailer 21 and go ahead with it on a floor.

Figure 7:
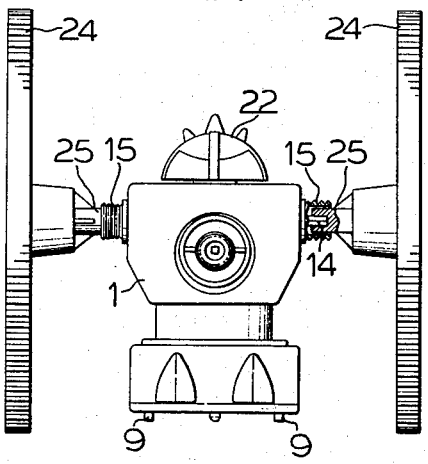
FIG. 7 is a front elevation of the spring prime mover unit thereof equipped with a pair of large wheels to both ends of a square shaft.
Figure 8:
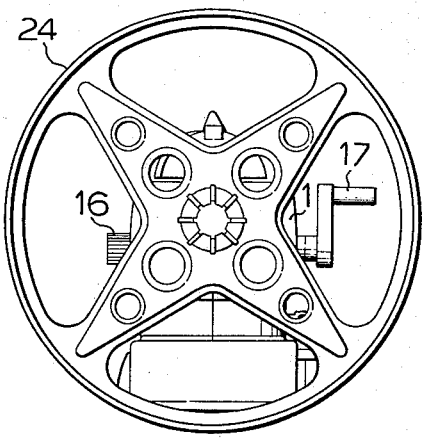
FIG. 8 is a side elevation of the spring prime mover unit in FIG. 7.

As shown in FIGS. 7 and 8, if both ends 14 of the square shaft 12 are inserted into bosses 25 of a pair of the wheels 24 having large diameter, said wheels 24 may rotate with said square shaft 12 and the spring prime mover unit may go ahead while hanging on said square shaft 12 between said wheels 24.

Figure 9:
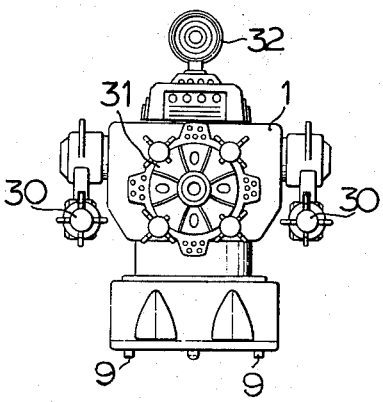
FIG. 9 is a front elevation of the spring prime mover unit thereof equipped with missile launchers and a radar.
Figure 10:
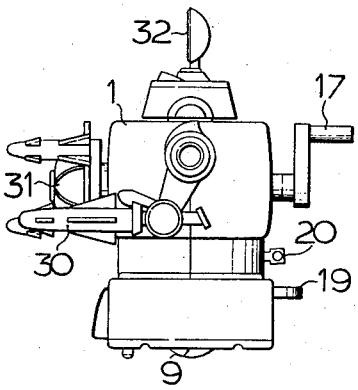
FIG. 10 is a side elevation of the spring prime mover unit in FIG. 9.

As shown in FIGS. 9 and 10, if the spring prime mover unit is provided with missile launchers 30 instead of the arms 23 of the robot and a radar 32 instead of the cap 22 and a plural missile launcher 31 to the tubular connector 16 of the main shaft 3, a toy missile launcher may be assembled.

Figure 11:
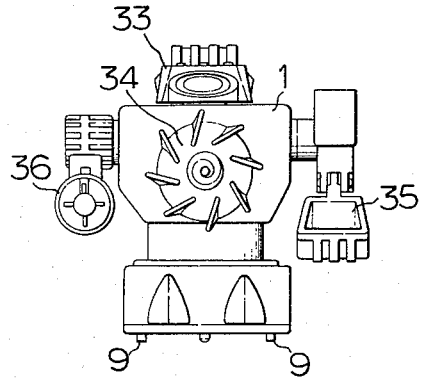
FIG. 11 is a front elevation of the spring prime mover unit thereof disguised as a rock drill equipped with a computor, a propelling drill, a bucket and a drill.
Figure 12:
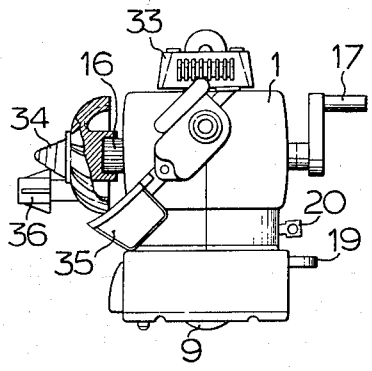
FIG. 12 is a side elevation of the rock drill shown in FIG. 11.

As shown in FIGS. 11 and 12, if the spring prime mover unit is provided with a computor 33 instead of the cap 22 of the robot, a propelling drill 34 to the tubular connector 16 of the main shaft 3, and a bucket 35 and a drill 36 to each of the tubular connectors 15 of the both sides of the box frame 1, respectively, a rock drill robot may be assembled.

Figure 13:
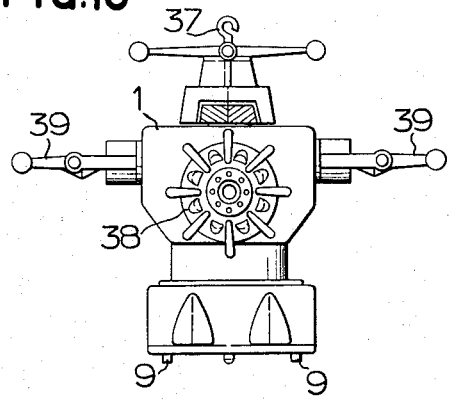
FIG. 13 is a front elevation of the spring prime mover unit thereof disguised as a rocket equipped with a hanger, a rocket engine and antennas.
Figure 14:
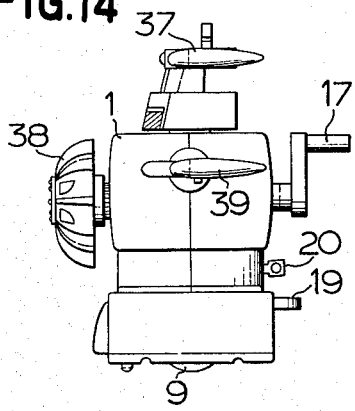
FIG. 14 is a side elevation of the rocket shown in FIG. 13.

As shown in FIGS. 13 and 14, the spring prime mover unit is provided with a hanger 37 instead of the cap 22, a pair of antennas 39 instead of both arms 23 and a rocket engine 38 to the tubular connector 16 of the main shaft 3, a toy rocket may be assembled. If said toy rocket is made to hang on a long stretched cord by the hanger 37, it may go and return on the cord by vertical reciprocation of one end of the cord as if a rocket flys in the air.

Figure 15:
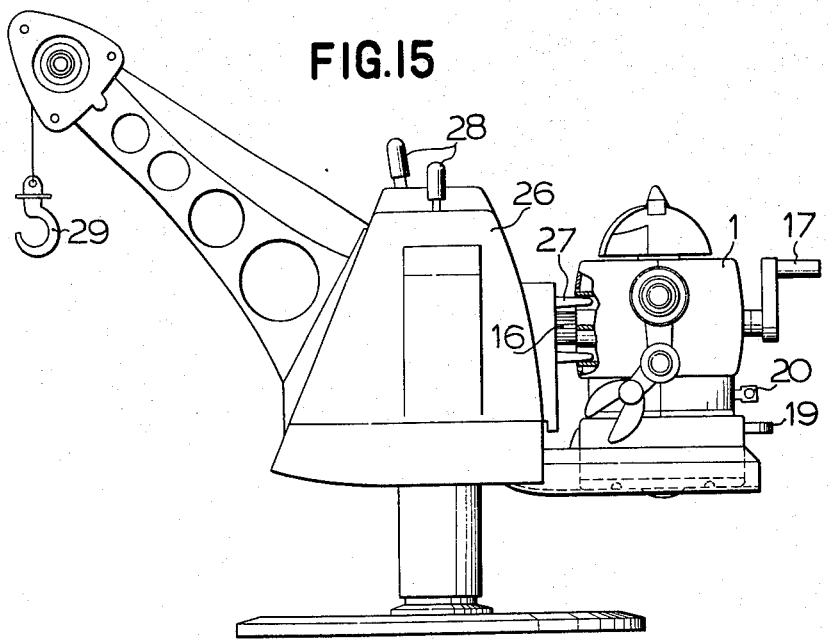
FIG. 15 is a side elevation of the spring prime mover unit thereof connected with a toy crane.

As shown in FIG. 15, if a connector 27 attached to the back of a toy crane 26 is connected with the connector 16 of the main shaft 3, a toy power crane is formed and may be revolved about a vertical support by rotation of the main shaft 3. A hook 29 of the toy crane 26 may be lifted and lowered by manipulating two levers 28.

As described above, the connector 6 of the main shaft 3 and the both ends 14 of the square shaft 12 are rotatable connection members, and the connector 18 of the top of the box frame 1, the connectors 15 of the both sides of the box frame 1 and the semicircular ring connector 19 are non-rotatable members. Therefore, innumerable different movable toys are assembled by connecting one spring prime mover unit with suitable auxiliary toy parts or connective toys.

Thus, the spring prime mover unit of this invention is a novel and useful device for children who play the toy.

What is claimed as new and desired to be secured by Letters Patent of the United States is:

1. A spring prime mover unit, comprising a spring prime mover, a transmission gear, a plurality of connectors, a mechanism frame and a box frame; said spring prime mover comprising a spring and a pair of drums, and set outside the mechanism frame; one of said drums being fixed to the front end of a main shaft and the other of said drums being mounted on a subsidiary shaft beneath said upper drum; said spring being fixed to the circumferences of each drum by both ends and having power of winding from the upper drum to the lower drum; said transmission gear comprising the main shaft, a square shaft, a rotatable shaft and an intermediate transmission gear; said main shaft passing through the mechanism frame in front and in the rear, journaled in said mechanism frame and equipped with the upper drum as described above and with a handle having an adjustor at the rear end, and said upper drum being fitted with a rotatable connector at the front; said square shaft passing transversely through the upper portion of the mechanism frame, journaled in said mechanism frame and being engaged with the main shaft by a worm and a worm gear, and both ends of the square shaft becoming rotatable connectors; said rotatable shaft passing transversely through the lower portion of the mechanism frame and being fitted with a pair of wheels at both ends and engaged indirectly with the main shaft by the intermediate transmission gear; said mechanism frame being fitted with a stopper to stop a winding back motion of the spring; and said box frame covering all the above members and being fitted with a connector at the top, with tubular side connectors at both sides in which both ends of the square shaft are housed without contact and with a semicircular ring connector at the lower portion of the back, and having an aperture for the connector of the main shaft and a pair of slots from which the wheels of the rotatable shaft are projected downward by halves.

2. A spring prime mover unit as claimed in claim 1 which is equipped with auxiliary toy parts on the connectors of said spring prime mover unit.

3. A spring prime mover unit as claimed in claim 1 which is equipped with toy having no prime mover on the connectors of said spring prime mover unit.

* * * * *